US007987823B2

(12) United States Patent
Wiens

(10) Patent No.: US 7,987,823 B2
(45) Date of Patent: Aug. 2, 2011

(54) HYBRID PISTON/ROTARY ENGINE

(76) Inventor: William Scott Wiens, Pompano Beach, FL (US)

( * ) Notice: Subject to any disclaimer, the term of this patent is extended or adjusted under 35 U.S.C. 154(b) by 717 days.

(21) Appl. No.: 12/011,107

(22) Filed: Jan. 24, 2008

(65) Prior Publication Data

US 2009/0188466 A1 Jul. 30, 2009

(51) Int. Cl.

| | |
|---|---|
| ***F02B 57/08*** | (2006.01) |
| ***F02B 25/08*** | (2006.01) |
| ***F02B 75/28*** | (2006.01) |
| ***F01B 13/06*** | (2006.01) |
| ***F01B 1/06*** | (2006.01) |
| ***F01B 13/04*** | (2006.01) |

(52) U.S. Cl. ..... 123/43 R; 123/44 E; 123/51 A; 91/491; 91/498

(58) Field of Classification Search ..... 123/44 B, 123/51 R, 18 R, 18 A, 43 R, 44 C, 44 D, 123/44 E, 51 A; 91/491, 498

See application file for complete search history.

(56) References Cited

U.S. PATENT DOCUMENTS

| | | | | | |
|---|---|---|---|---|---|
| 600,886 | A * | 3/1898 | Obermeyer | 91/485 |
| 951,388 | A * | 3/1910 | Conill | 123/44 B |
| 1,087,240 | A * | 2/1914 | Kellington | 123/51 A |
| 1,115,397 | A * | 10/1914 | Clawson | 91/491 |
| 1,485,988 | A * | 3/1924 | Hermann | 123/51 B |
| 1,827,094 | A * | 10/1931 | McCann | 123/44 B |
| 1,990,660 | A * | 2/1935 | McCann | 123/44 B |
| 2,217,796 | A * | 10/1940 | Eugene | 123/44 B |
| 3,392,631 | A * | 7/1968 | Baker | 91/493 |
| 3,927,647 | A * | 12/1975 | Blackwood | 123/44 D |
| 3,964,450 | A * | 6/1976 | Lockshaw | 91/493 |
| 4,038,948 | A * | 8/1977 | Blackwood | 123/44 D |
| 4,177,771 | A * | 12/1979 | Nutku | 123/44 B |
| 4,653,438 | A * | 3/1987 | Russell | 123/44 B |
| 5,343,832 | A * | 9/1994 | Murray | 123/44 B |
| 5,671,702 | A * | 9/1997 | Lindblad | 123/44 D |
| 6,904,877 | B2 * | 6/2005 | Stokes | 123/54.3 |
| 7,066,115 | B2 * | 6/2006 | Arseneau | 123/44 B |
| 7,610,894 | B2 * | 11/2009 | Tinker | 123/197.3 |
| 2009/0159355 | A1 * | 6/2009 | Garwood et al. | 180/165 |

FOREIGN PATENT DOCUMENTS

DE 3730558 A1 * 3/1989

* cited by examiner

*Primary Examiner* — Thai Ba Trieu

(57) ABSTRACT

A Hybrid Piston/Rotary engine has a stationary elliptical housing with a circumscribed inner cam surface to provide thrust, and sides with bearing supports for rotation of a rotor, at least one cylinder, a shaft with apertures therein to provide rotary valves combined with intake and exhaust ports within the bearing supports. Each cylinder has two opposed pistons connecting cam followers pivoted to the rotor which reciprocate upon rotation. During the intake stroke, the pistons separate as an intake valve opens; and fuel mixture fills the cylinder and closes as pistons compress the mixture. The rotor ports become aligned with the spark plugs within the bearing supports, and ignited gasses force the pistons apart causing the cam followers to provide thrust to the rotor. The exhaust valve is opened as the pistons contract. Four strokes are completed each rotation. The valves can also be arranged to operate as a pump.

9 Claims, 9 Drawing Sheets

VB
EX
SP
PS
AF
INT

BEGINNING OF INTAKE STROKE

INTAKE STROKE VALVE OPEN

10° BEFORE BDC COMPRESSION STROKE BEGINS

COMPRESSION STROKE 80° IN DURATION (EACH FIGURE IN 45° INTERVALS.)

IGNITION & POWER STROKE BEGINS

POWER STROKE 180° IN DURATION

10° BEFORE BDC EXHAUST STROKE BEGINS

EXHAUST STROKE 80° IN DURATION

HYBRID PISTON/ROTARY ENGINE VS CRANKSHAFT 4-STROKE

HYBRID PISTON/ROTARY ENGINE

BACKGROUND

1. Field of Invention

The present invention relates to rotary engines as well as conventional piston engines having beneficial aspects of both. It is a hybrid combination of features that fundamentally operates as an Atkinson cycle four stroke utilizing the advantages of the Junkers opposed piston design. This design also implements rotary valves, similar to the Wankel engine. There are some prior art rotary engines which share similar elements, such as one disclosed by Albert which has a common combustion chamber with opposed pistons in which the cylinder is stationary, and others which have an elliptically shaped housing but do not incorporate the same features and are different in structure, operation, and advantages.

2. Description of the Prior Art

Most conventional internal combustion engines utilize a crankshaft to convert reciprocating piston motion into rotary motion. Also known as the crank-slider mechanism which had been commonly used prior to the advent of steam engines. This crank mechanism provided mobility to bicycles, spawned the industrial revolution as perfected by James Watt in the steam engine, and later propelled the automobile in the Otto cycle engine. Further developed by Lanchester, Daimler, Lenoir, and a host of well known and legions of unknown contributors in which a library of devoted work is attributed.

There are certain kinetic limitations to the crank mechanism. At the top and bottom segments of each stroke there is reduced leverage to perform work. There is no leverage at top dead center (TDC). An area of dwell exists for about thirty degrees where there is little or no motion provided to the piston. As the crankshaft rotates from TDC, leverage (gradually) increases from 0 (zero) to maximum leverage (from 60 to 120 degrees.) This area of maximum leverage is the "sweet spot" where most of the work is performed. Also toward the bottom of the stroke leverage is again progressively diminished. Under load, at lower engine speeds, combustion forces are constrained causing cylinder pressures to increase (spike), which can produce pre-ignition, resulting in knock that will lead to engine destruction. Higher-octane fuels are commonly used to retard combustion thus counteracting the moment of ignition until leverage is available.

The present invention provides a mechanism that produces a contiguous progression of leverage due to its mechanical linkage. Piston movement is continuous and more sinusoidal having less dwell at TDC and BDC. A larger torque arm provides more leverage to perform work producing a wider sweet spot. Also being a more balanced and efficient means of converting reciprocating motion into rotary motion than the crankshaft.

Various forms of the Otto cycle engine, derived from the crank-slider mechanism have resulted in engines with increased mechanical efficiency. The Diesel cycle engine utilizes a higher compression ratio to operate on low quality fuel that is harder to ignite but has higher energy content. Highly compressed air ignites the fuel as it is injected into the cylinder at TDC, which is known as compression ignition.

Another variation of the crank-slider is the Atkinson cycle engine, which increases mechanical efficiency by providing expanded strokes. A separate link between the crankshaft and the connecting rod varies the length of certain strokes, adjacent to less critical strokes. The expansion stroke is larger in volume than the compression stroke and is known to increase efficiency.

An opposed piston design pre-dating WWII by Hugo Junkers operating as a diesel 2-cycle engine proved the benefits of eliminating the cylinder heads, which were prone to crack and even today are a substantial cause of engine failure. Having opposed pistons reduces heat transfer and permits much higher operating temperatures and pressures than otherwise possible. Each piston is connected to separate crankshafts and synchronized slightly out of phase to allow scavenging through intake and exhaust ports in the common cylinder. Additional benefits of the opposed piston (O-P) design are, combustion forces are transferred equally through opposed pistons and more closely duplicates the natural model of combustion. Equilateral pressures force the pistons apart in both directions, and the flame front does not have to travel as far down the cylinder. The main bearings, piston pins, connecting rods, and associated parts absorb fewer stresses from combustion related forces.

The Hybrid Piston/Rotary engine as disclosed provides similar mechanical advantages to these previous designs without the mechanical complexities while reducing the number of parts and is more compact.

Another variation providing an alternative mechanism to the crank-slider is the Scotch yoke mechanism (Bourke engine). This mechanism increases dwell time at TDC and BDC, which is thought to increase mechanical efficiency. There are two schools of thought as to which is preferable. To dwell or not to dwell. Another is the Geneva stop (Maltese cross) mechanism as well as the swash plate mechanism. None of these contrivances are in wide use today or had any success in engines.

The Wankel rotary engine is conventionally different, having a triangular rotor and elliptical housing instead of pistons and a traditional cylinder. It utilizes a simplified rotary valve, which reduces parasitic frictional losses and permits higher revving output while providing all four strokes in a single rotation of the takeoff shaft. Instead of a crankshaft, a three lobed rotor oscillates trichoidally to forcibly gyrate an eccentric shaft, which is the power shaft.

Several rotary engines have opposed pistons, including a design by Albert, which has an elliptical housing that rotates around a stationary common cylinder. The pistons are connected to rollers but do not provide a valid method for retracting the pistons during the intake stroke. Designs by Murray provide a rotating block of multiple cylinders without opposed pistons but has rotary valves and air-cooling. The pistons are connected to rollers on cam followers, which are retracted centrifugally by counter weights.

The Hybrid Piston/Rotary engine utilizes rotary valves similar to the Wankel rotary engine. It provides four distinct strokes every revolution of the rotor shaft with the expanded strokes of the Atkinson design. It has opposed pistons similar to the Junkers engine that eliminates the need for a cylinder head. Both pistons distribute cylinder pressures equally and each piston shares half the pressure of combustion. By providing a more efficient mechanism than the crankshaft, it provides a continuous sinusoidal motion to the pistons. Utilizing the benefits of current piston engine technology while improving combustion by turbulent vortex mixing.

OBJECTS AND ADVANTAGES

An objective of the present invention is to provide a hybrid engine design that shares the clean combustion attributes of the 4-stroke Otto cycle piston engine for increasing turbulence to promote more thorough combustion and cleaner emissions.

And also to provide an increase in mechanical efficiency as the Atkinson cycle engine, by providing expanded strokes for the intake and power strokes having a supercharging effect without extraneous parasitic means.

And being more compact and less complicated as the Wankel rotary engine with a power stroke every revolution of the rotor shaft providing greater power density.

It is another object to provide a rotary valve, which reduces frictional losses and simplifies operation while significantly reducing intricate parts. To easily provide an intake valve, exhaust valve, and spark plug on each side of the cylinder as well as a pre-chamber where combustion is initiated adjoining the cylinder.

It is yet another object to provide an engine with superior torque characteristics as well as the capability to operate at high RPM's having inherently balanced characteristics.

Another objective is to provide an alternative to the crankshaft mechanism, which eliminates the need for a cylinder head and utilizes a less complicated mechanism with two pistons per cylinder to better distribute power. Producing continuous leverage and having a greater torque arm with a larger sweet spot to provide useful power.

It is a further objective, embedded within the scope of embodiments, the ability to be configured as a pump for compressing and moving working fluids, (liquids or gasses) as well as the capacity to be arranged as a motor powered by liquids or gasses (example—air compressor, steam engine, hydraulic pump, hydraulic motor, etc.). By changing the position of the intake and exhaust valves, it is easily adaptable and for such applications other embodiments are provided. As such, each rotation of the rotor produces two distinct pumping cycles, comprising two intake strokes and two exhaust strokes.

It is a considerable feature of the present invention to provide variable valve timing.

Substantially it is purposed that the geometric variance of possible configurations can be tailored to specific applications as necessary and is described specifically, providing a wide range of possibilities.

SUMMARY OF THE INVENTION

A Hybrid Piston/Rotary engine is disclosed which shares the functions and many of the properties of a conventional Otto cycle piston engine as well as those of a rotary engine. Being similar in appearance to a Wankel rotary engine, an external housing is elliptically shaped and performs as a cam to provide thrust from an enclosed rotor, which is supported for rotation therein. Instead of a conventional crankshaft, the rotor is comprised of a cylinder (or cylinders) connected to a shaft, which rotates within bearing surfaces supported by the housing. The rotor cylinder contains two opposed pistons, which work in reverse direction of each other. There is no conventional cylinder head as each piston is effectively the cylinder head of the opposing piston. Compression is contained between them as well as expansive forces thrust against both pistons pushing them apart. Each piston is connected to a respective cam follower assembly by a connecting rod. Each cam follower is pivotally attached on opposite sides of the rotor and at opposite ends of each cam follower are mounted rollers.

Upon rotation of the rotor, the cam follower rollers follow the curvature of the elliptically shaped housing, causing them to reciprocate according to the contour of the housing. The connected pistons are caused to reciprocate accordingly. For each rotation of the rotor shaft the pistons are forced together and apart twice. Essentially, when the pistons are not moving together, they are moving apart and cannot remain motionless due to their geometric relation to the cam housing. Because both pistons move in opposite directions and transfer torque equally to the inner circumference of the cam housing, this provides a larger torque arm or area where the piston can provide thrust. There is a larger sweet spot as this mechanism continuously produces leverage invariably and translates a more sinusoidal motion to the pistons. Combustion pressures are transferred equally between the opposed pistons, forcing them apart and more closely duplicates the natural model of combustion. Combustion propagates from the center and the flame front does not travel as far down the cylinder. The pistons, pins, connecting rods, cam followers and related parts endure half the combustion related stress of a conventional engine. Unbalanced dynamic forces are also much lower as pressure is exerted equilaterally to both sides of the cam housing distributing a balanced inertial mass in diametric proportions. Secondary imbalances are less problematic. Multiple cylinder configurations can be arranged or stacked in series according to conventional means and all existing methods for piston engine technologies apply readily to this design.

The rotor includes a port aperture positioned in the center of the cylinder and extends through the rotor shaft journals to form a rotor port. As the shaft rotates, the port comes in alignment with corresponding ports in the bearing supports allowing them to effectively open and close, forming a rotary valve. Each bearing support has an intake port and an exhaust port coupled to their appropriate manifolds. Single port arrangements can also be implemented, where an intake rotary valve is on one side of the rotor and an exhaust rotary valve is on the other; or arranged with both ports on one side. This arrangement reduces the expense of providing dual fuel carburetion and exhaust manifolds. Each rotor shaft bearing support (valve/bearing) achieves multiple purposes; 1) to provide rotational bearing support for the rotor; 2) to function as a rotary valve for allowing working fluids to flow into and out of the attached cylinder; 3) to provide a spark plug situated in a position to initiate combustion as the rotor port comes in alignment with it at TDC (or fuel injector for diesel variants of the engine); 4) to function as a breech or opening within the combustion chamber. Each rotor shaft port aperture is a combustion pre-chamber in which combustion is initiated and propagates to the cylinder; and 5) to provide cooling elements within or around the rotary valve to lower operating temperatures as necessary. Hereafter this member will be referred to as the valve/bearing.

The 4-stroke cycle of the present invention consists of; (1) The intake stroke begins with the pistons contracted and the rotor shaft port is rotating into alignment with the intake port on the valve/bearing, opening the intake port accordingly. The pistons are caused to retract apart as the connected cam followers move within the elliptical contour of the cam housing. This draws in an air-fuel mixture and the port is closed accordingly at the end of the intake stroke. The cam followers being pivoted to the rotor and connected to the pistons, are not fully retracted until approximately 100 degrees of rotation. (2) The pistons then compress the mixture as the cam followers cause the pistons to contract upon rotation. After approximately 80 degrees of rotation they have reached maximum ascent within the cylinder, and the rotor shaft port is in alignment with the spark plug within the valve/bearing. The spark plug is caused to fire. (3) The compressed mixture is ignited just before 180 degrees of rotation and combustion occurs. The expansion of the contained gasses force the pistons apart causing the cam followers to reciprocate and provide thrust against the cam housing, transmitting power and rotation to the rotor shaft. The power stroke is permitted a proportionately longer interval of 100 degrees to capture expanding gasses and allow more complete combustion. (4) At the end of the power stroke (approx 280 degrees), the exhaust valve is effectively opened as the pistons contract, forcing exhaust gasses from the cylinder and is closed after 360 degrees of rotation. Hence, the pistons have retracted and contracted twice, and all 4 strokes have been completed in a single rotation. Each cylinder can be provided with one rotary valve per side or two valves per side, which is the preferred embodiment. This arrangement allows for two intake valves, two exhaust valves, and two spark plugs per cylinder. Also the rotor shaft can be arranged with a series of multiple cylinders, as required. The geometric length of the expanded stroke can be altered as necessary for any particular application and a wide variety of cam housing contours can be considered to produce a desired ratio. The aspect ratio as well as the rod/stroke ratio can be determined for specific applications.

Similar to a Wankel rotary engine, a power stroke is produced each revolution of the rotor shaft and friction from rotary valve actuation has very little parasitic loss. Unlike the Wankel, there is no overlapping of strokes where exhaust gasses can mix with the intake mixture because the valves are completely closed from one stroke to the next, negating possible backfire.

The Atkinson cycle engine provides a crankshaft linkage, which produces a longer expansion stroke than compression stroke. This is known to produce greater mechanical efficiency. However the mechanical complexities and space requirements have been constraints for this design. The present invention is an Atkinson cycle engine according to actual definition, and provides a simpler, more efficient mechanism, with fewer parts, and is smaller in size.

Valve Operation

The conventional four-stroke piston engine utilizes poppet valves, which are opened by a camshaft and caused to close by valve springs. The tension of the springs has to be sufficiently stout enough to force them closed before the piston reaches the top of the next stroke, which is critical at high operating speeds. At high RPM's valve float can occur and limit how fast an engine can operate. Frictional losses from valve train operation can consume up to 20 percent of an engines gross power. This is wasted energy that diminishes engine efficiency.

Wankel type rotary engines utilize rotary valves, which open and close as the rotor slides past the intake and exhaust ports. This sliding motion is almost effortless and is a considerable benefit to the engines ability to rev at RPM's beyond most production engines. This rotary valve is simple, efficient, and performs very well making it a prominent feature of this design. Yet, the continuously changing shape of the combustion chamber which is formed relative to the movement of the rotor, causes an elongated irregular combustion chamber that is less conducive to enabling the combustion process. A round cylinder has better sealing characteristics and is the ideal shape to allow complete combustion.

The rotary valve in the present invention requires very little effort to operate as the bearing and the valve are the same component. Valve/bearing friction is minimal and the bearing surfaces can be lined with polymeric coatings or consist of other low friction materials. The volume and size of the rotary valve can be enlarged to increase flow by increasing the diameter of the rotor shaft and port opening. The duration interval, where the valve remains opened, equals the length of rotation from the beginning of the stroke to the end of the stroke. The size of the port aperture can also be lengthened (axially) to increase volume. This can be done without effecting the opening or closing event of the valve. Also the rotor port aperture works in unison with the intake and exhaust port apertures on the valve/bearing to form the respective rotary valves. As the intake stroke is proportionately longer than the exhaust stroke, the width of these port apertures can be balanced to provide the best operating characteristics suitable for a given application. The flow and volume of the rotor port apertures can also be balanced with regard to its volume as a pre-chamber.

The rotor port apertures connecting the cylinder are part of the combustion chamber (on both sides), and they function as pre-chambers for combustion. Each pre-chamber can have its own spark plug provided on the valve/bearing for spark ignited variations or can have separate injectors for diesel variants. On variations of the engine which include an intake and exhaust valve on each side of the cylinder, it is possible to allow a lean mixture on one side of the cylinder and a rich mixture on the other or utilize different fuels. Also, altering valve timing by rotating the valve/bearings radially one side opposite the other can change combustion characteristics to facilitate heavy load conditions or high RPM, as necessary.

The larger sweet spot of the present mechanism is less sensitive to spark advance in ignition timing because there is less dwell near TDC. Conventional crankshaft engines are more dependent on spark advance to time the precise downward movement of the piston because there is diminished piston movement and leverage at TDC.

Enhanced Combustion

A fuel mixture entering the cylinder of an engine during the intake stroke contains miniscule droplets of fuel that are not completely vaporized. It is well known that by increasing the turbulence within the cylinder improves the combustion process exponentially. This has the effect of rapidly blending the numerous species of chemical reactions that take place in milliseconds upon combustion. Ideal combustion is the byproduct of increased turbulence.

The present invention significantly increases turbulence by virtue of its kinetic induction characteristics. The intake charge enters the intake port with extreme velocity. The rotational speed of the rotor in relation to the stationary intake port causes radical swirl, creating a vortex. As rotor speed is increased, the velocity of swirl is proportionately extreme due to the kinetic variance. Furthermore, each cylinder has ports on opposite sides and there is a multi-directional tumble of gasses within the cylinder as the pistons retract. After the cylinder is filled, the pistons contract to compress the mixture for combustion. There is tumultuous atomization and hyper-mixing of gasses which thoroughly combine the countless species of chemical reactants to formulate complete and clean combustion. This rotational twist creates a vortex within the cylinder causing a low pressure, high velocity swirl within the center of the combustion chamber between the pistons. This swirl moving outward to a higher pressure, low rotational swirl as the pistons retract and contract throughout the four stroke cycle.

DESCRIPTION OF THE PREFERRED EMBODIMENT

Figure 1:
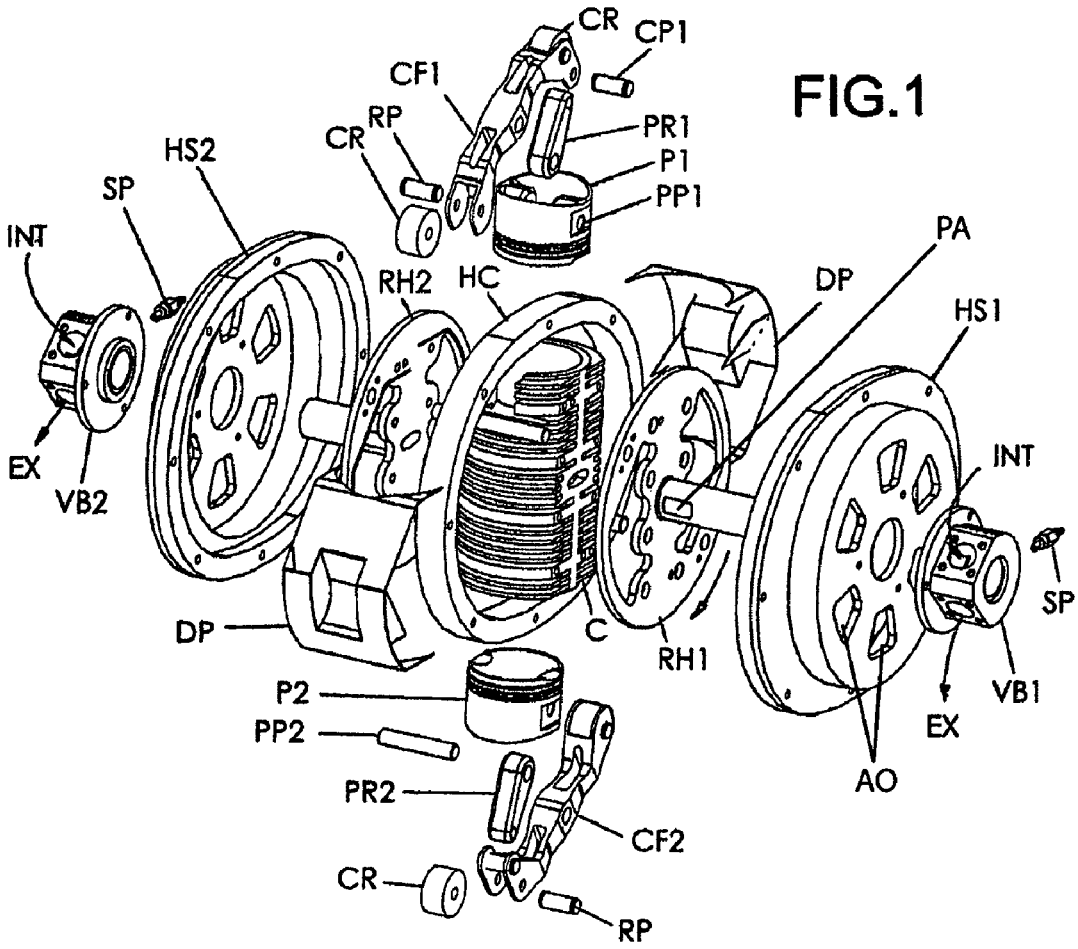
FIG. 1 shows an exploded isometric view of the components in the preferred embodiment where an intake and exhaust are provided on each side of the rotor (an arrow designates direction of movement or flow)
Figure 2:
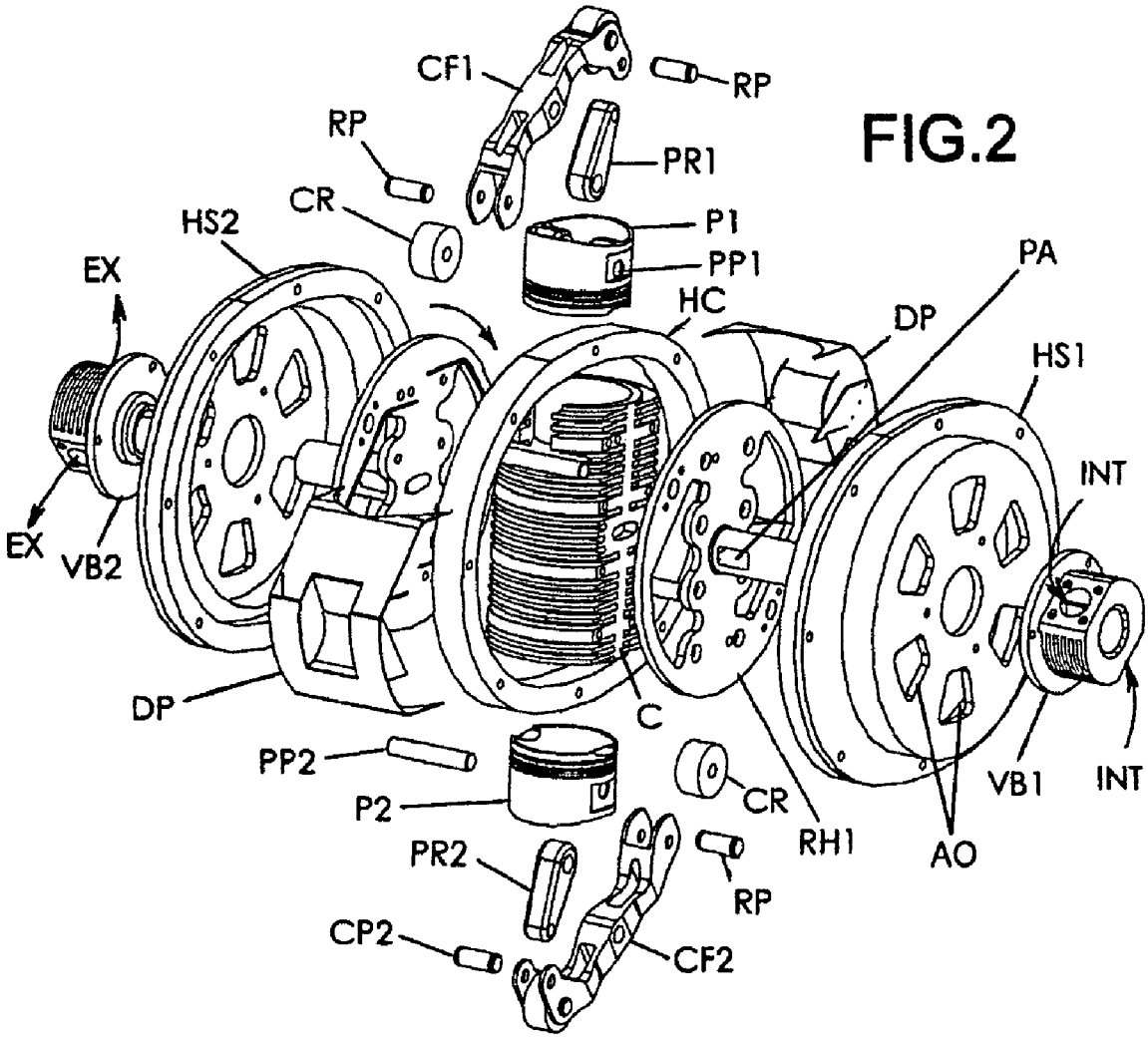
FIG. 2 shows an exploded perspective view of the pump/motor arrangement of the same mechanism with valve/bearing VB1 that are both intake ports and the valve/bearing VB2 that provides both exhaust ports, no spark plugs are present in this configuration.

Referring to the drawings, the present invention is disclosed in FIG. 1 (which is shown with dual intake and dual exhaust valves), also shown in FIG. 2, as a different configuration in which the same mechanism has valve/bearings with port openings arranged as a pump/motor configuration. Two intake and two exhaust strokes are produced twice (providing two pumping cycles) each revolution.

In FIG. 1, the engine configuration is shown in which a rotor R, consisting of a cylinder C, with attached rotor halves RH1 and RH2, having bisecting shafts extending as journals for rotation within a stationary housing assembly. The housing is comprised of three sections; an elliptically shaped middle section or housing cam HC, and two exterior housing sides HS1 and HS2, which provide support for valve/bearings VB1 and VB2 for rotational support of the rotor. Positioned within the cylinder C are two opposed pistons P1 and P2, which face each other and being adjoined by piston pins PP1 and PP2, are connected to corresponding piston rods PR1 and PR2, positioned respectively. Two cam followers CF1, and CF2, are attached respectively to the piston rods by connecting pins CP1 and CP2. The cam followers are pivotally mounted to the rotor with follower pins FP1, and FP2. The cam followers each have two similar corresponding cam rollers CR, fixed for rotation on opposite ends of their respective assembly by similar roller pins RP, to communicate within the circumscribed interior of the housing cam HC. As the rotor is caused to rotate within the housing, both cam follower assemblies CF, are also caused to reciprocate their respective connected piston rods and pistons. The pistons retract and contract in opposite direction and between them is formed the combustion chamber. Divider partitions DP, are positioned between the rotor halves and cylinder to divide the interior air-cooled section of the rotor from the oil lubricated exterior section of the rotor.

FIG. 2 represents the pump/motor embodiment of the mechanism with valve/bearing which provide two distinct pumping cycles per rotation. Each are comprised of two strokes, an intake of the working fluid and an exhaust of the working fluid. As such, the incoming fluid is provided a longer intake interval than the adjacent outgoing stroke. This allows a greater volume of fluid to be moved or compressed than a conventional mechanism with an equivalent displacement can achieve, as the result of its increased mechanical efficiency. The flow of fluid is from one side of the mechanism to the other making the respective manefolds simpler to arrange and connect.

DESCRIPTION OF THE PREFERRED EMBODIMENT

Figure 3A:
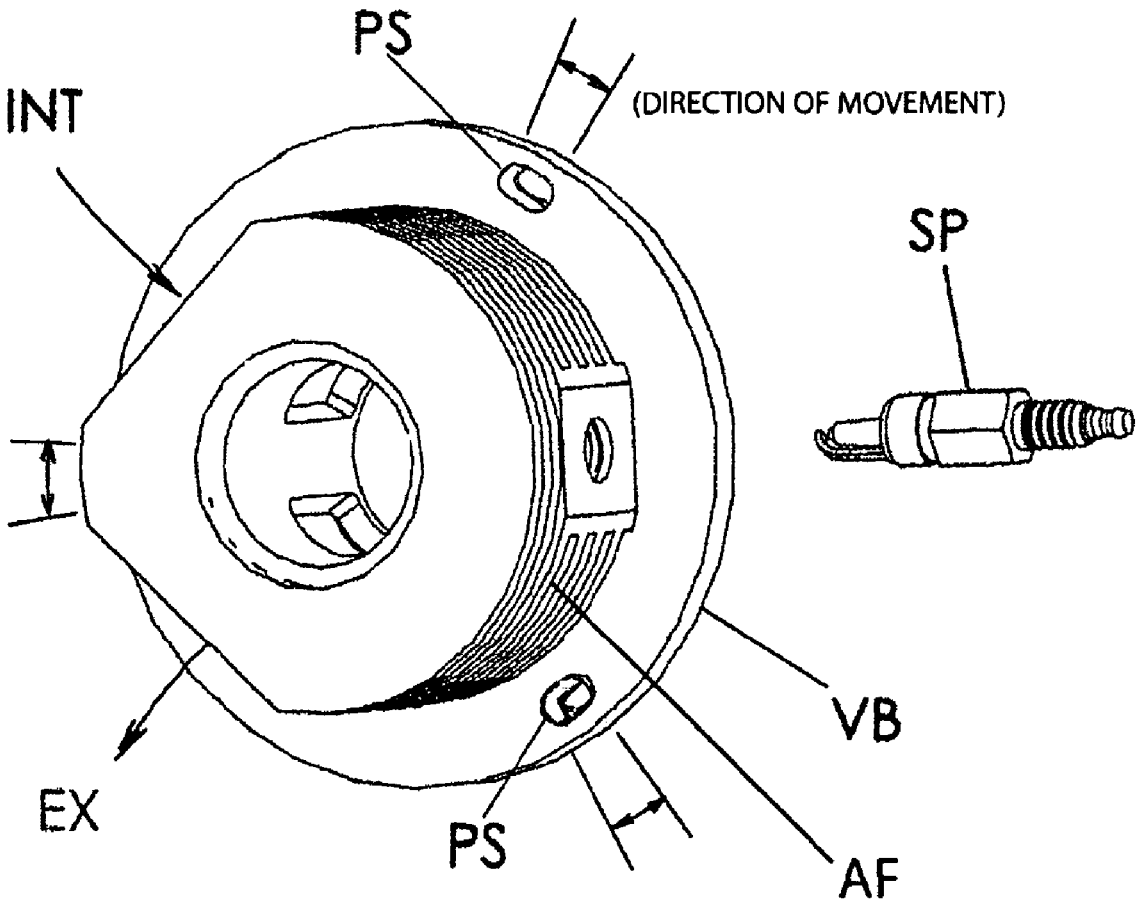
FIGS. 3A, 3B, and 3C show three different views of the rotary valve in detail for the two port configuration of the valve/bearing having an intake, an exhaust, and a spark plug on each valve/bearing, valve advance being shown in slotted holes for slidable rotation, arrows showing direction of flow and movement for slidable rotation of valve/bearing, and single port, double port, and pump arrangement (except spark plug) all sharing the same elements and working relation with each other.
Figure 3B:
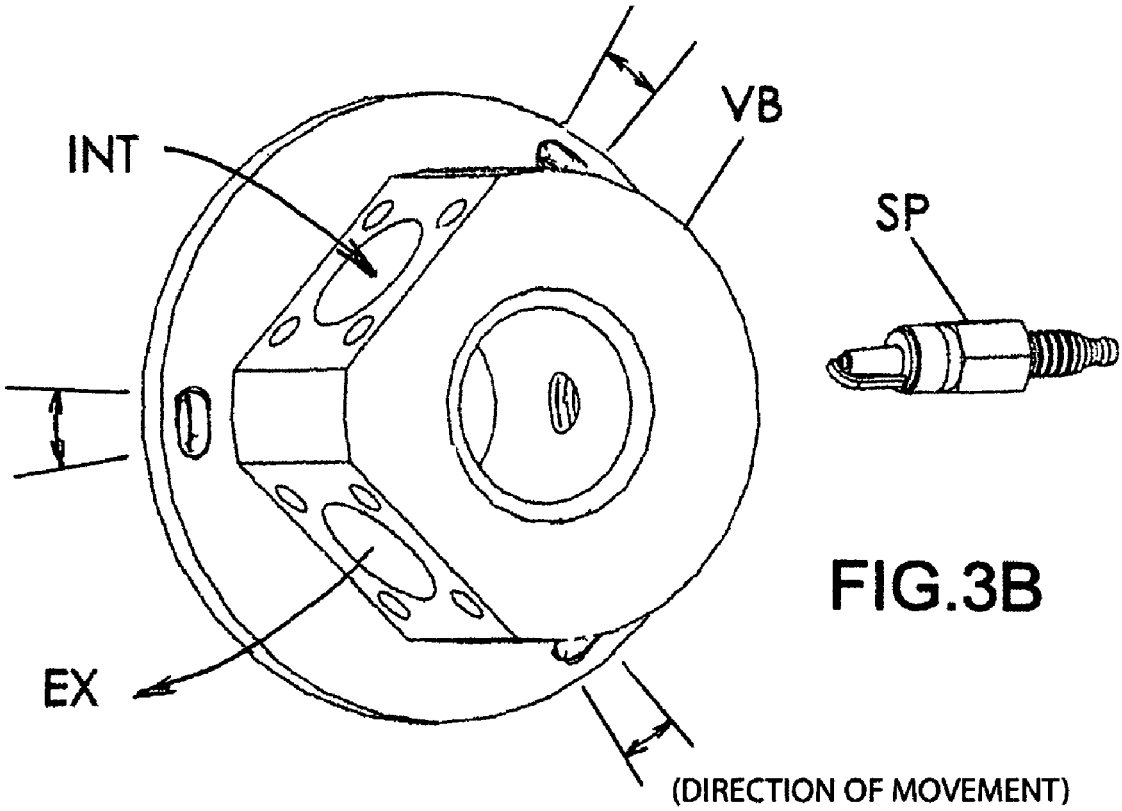
Figure 3C:
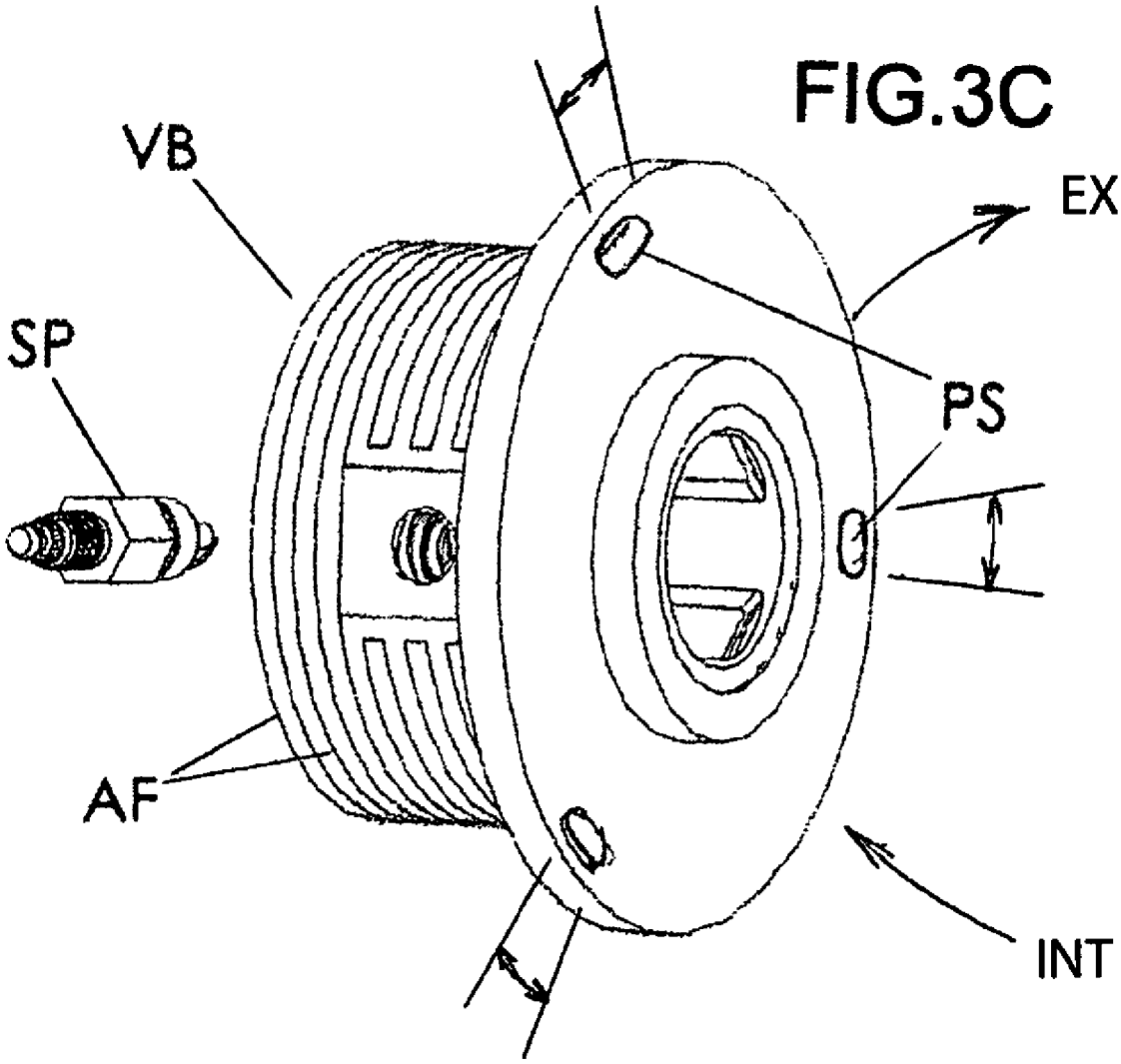
Figure 4A:
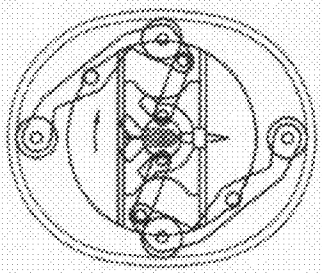
FIGS. 4A-4H shows 8 figures outlining the sequence in motion of the four stroke cycle over the span of 360 degrees (in 45 degree intervals).
Figure 4B:
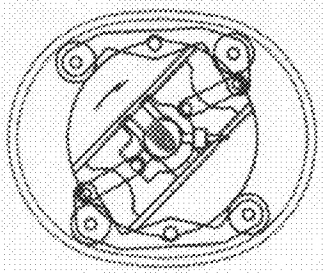
Figure 4C:
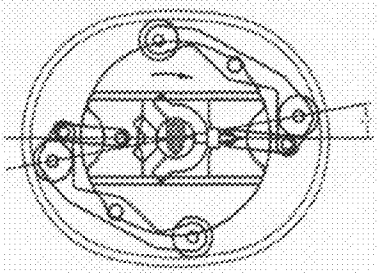
Figure 4D:
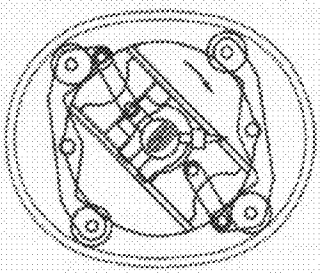
Figure 4E:
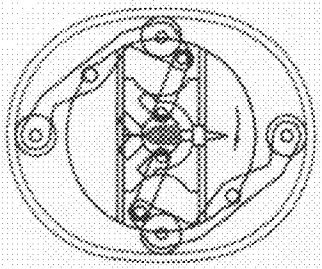
Figure 4F:
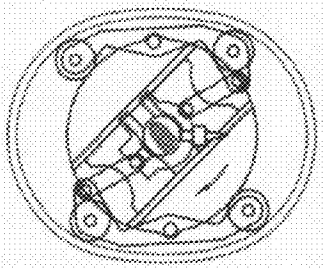
Figure 4G:
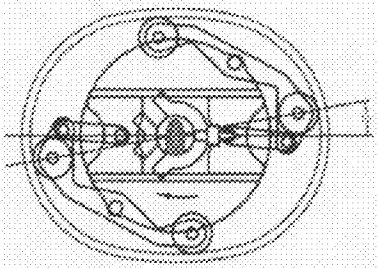
Figure 4H:
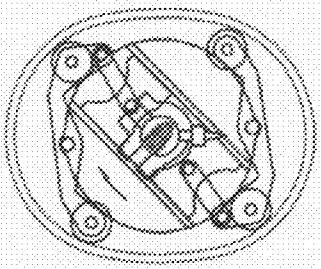

Shown in FIG. 3A thru 3C, are views of the rotary valve representing a view of the preferred embodiment and is shown having 2 intake and 2 exhaust ports, and a spark plug positioned on each valve/bearing which is the identical part for both sides. When the shaft aperture (not shown) comes in alignment with the intake port INT, the intake valve is opened and, likewise, when the aperture is in alignment with the exhaust port EX, the exhaust valve is opened. Also formed within each valve/bearing is a spark plug SP, positioned in alignment with the shaft port aperture. An appropriate ignition system (not shown) causes the spark plug to fire at the top of the compression stroke when the shaft aperture is in alignment and ignites the fuel mixture within the cylinder. For compression ignition configurations, a fuel injector would replace the spark plug location. Also not shown (though obvious) is the intake manifold which connects the port to appropriate means, either carburetor or fuel injector. An appropriate exhaust manifold connects the exhaust port in like manner as is apparent.

Also among the many functions of each valve/bearing is to provide cooling air fins AF, which act as heat sinks to dissipate or accumulate heat. Cooling can be achieved through convection of air or liquid means. The valve/bearing in combination with the rotor shaft port aperture form a breach where combustion is Initiated and is also a pre-chamber to the attached cylinder. They are positioned on both sides of the cylinder providing twice the available volume for induction, propagation, and expulsion of fluids throughout the four stroke cycle. The symmetry of this arrangement ensures thorough combustion and enhances the tumble, swirl, and radical turbulence.

Variable valve timing capabilities are also shown in FIGS. 3A, 3B, and 3C. Under certain operating conditions it may be beneficial to vary valve timing by either advancing or retarding the interval which the valves are caused to open and close. The present invention provides means by which this is easily performed. Shown is the preferred embodiment of the engine valve bearing but is not limited to it, alone.

According to the drawings, FIGS. 3A, 3B, and 3C shows the valve/bearing VB, (both sides are identical, and will be referred to universally) consisting of port apertures for an intake INT, and an exhaust EX. The valve/bearings are slidably secured by fasteners through pivot slots PS, to their respective housing side HS (not shown), allowing each to be rotated incrementally around the axis of the rotor shaft independent of each other. During some operating conditions these can be staggered, allowing one to overlap the position of the other or move together as necessary, to alter the sequence of valve timing. In effect providing an increased duration of valve overlap where one valve opens and closes proportionally before the other. Also shown is the spark plug SP.

Referring to the drawings of FIG. 4, with suffix A thru H; these 8 figures outline the sequence in motion of the four-stroke cycle over the span of 360 degrees (in 45 degree intervals). FIG. 4A, Shows the beginning of the intake stroke. The rotor shaft port is coming into alignment with the intake port on the valve/bearing and the valve begins to open incrementally as the rotor is caused to rotate (arrow indicates direction). The cam followers are caused to reciprocate and their respective pistons retract, filling the cylinder. FIG. 4B, Shows almost half way through the intake stroke the intake valve is open and the fuel mixture is sucked into the cylinder. Until the rollers are situated on the corners of the cam housing, the pistons are still in motion. This cycle takes approximately 100 degree before the pistons are at BDC. FIG. 4C, The cylinder is shown at 90 degrees and after another 10 degrees of rotation the compression stroke begins. The pistons contract more rapidly than they expanded due to their mechanical linkage with the cam followers. Shown in FIG. 4D, The fuel mixture is compressed inwardly by continuous, simultaneous thrust from both pistons which after about 80 degrees of rotation reach TDC. FIG. 4E, Reveals a fully compressed intake charge where the cam rollers are on the corners of the cam housing and the pistons are fully contracted. The spark plug positioned within the valve/bearing is directly in aligned with the rotor shaft port and the spark plug is caused to ignite the mixture just prior to TDC. Combustion begins and expanding gasses rapidly force the pistons apart with intense velocity. FIG. 4F, Shows the power stroke after 45 degrees from TDC. The expansion stroke is providing a proportionately longer duration of 100 degrees to harness the power of combustion. Shown in FIG. 4G, After another 10 degrees of rotation, the pistons are fully retracted having an extended interval to provide work. The exhaust port is then allowed to open and exhaust gasses are rapidly expelled from the cylinder. This stroke is proportionally shorter being 80 degrees in duration. FIG. 4H—Shows the exhaust port in the fully opened position and the ascending pistons similarly cause exhaust gasses to be expelled from the cylinder during the remaining 45 degrees. The exhaust port is gradually caused to close toward the end of the stroke. Subsequently within 360 degrees all four strokes of the Atkinson and Otto cycle description are completed. Continuous cycles ensue providing a seamless supply of power as necessary.

Figure 5:
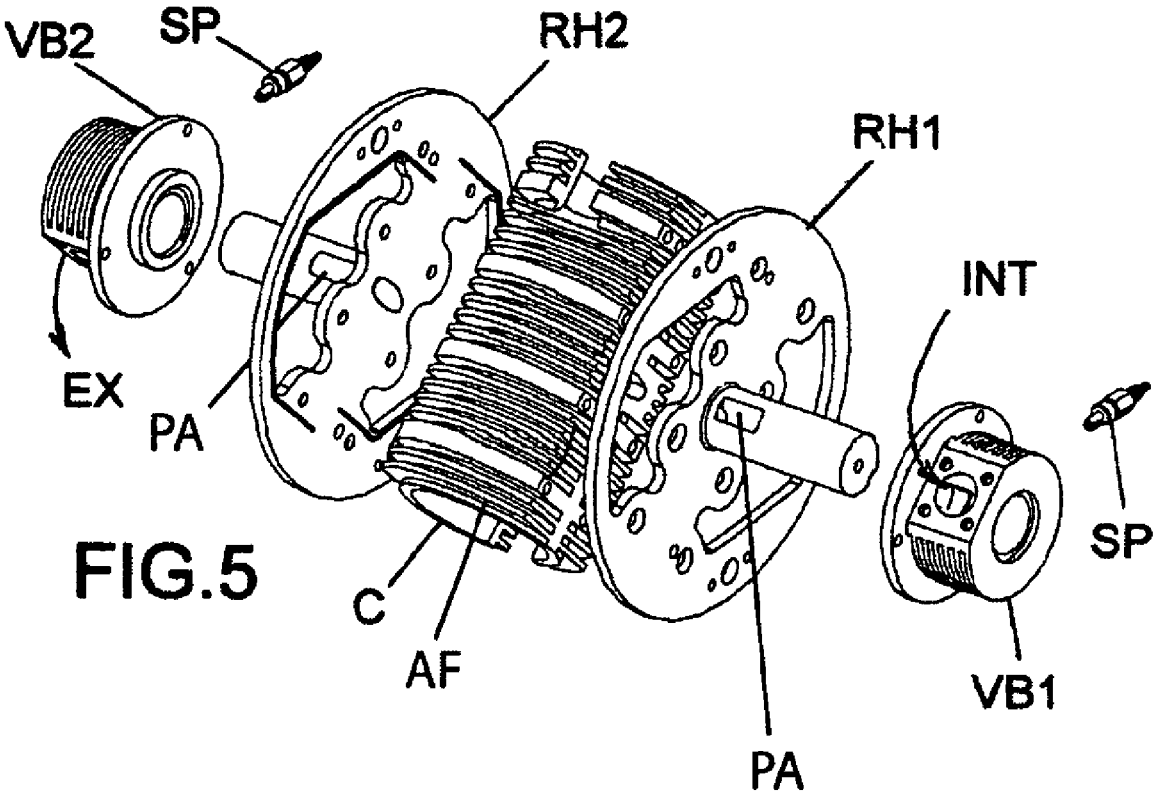
FIG. 5 shows a view of the single port valve/bearing, the rotor being stripped down without; divider partitions, pistons and the attached cam follower assemblies, or pins with the housing and all of its elements being removed for clarification, and the rotor being shown in the intake open position which is also shown in the FIG. 4B.
Figure 6:
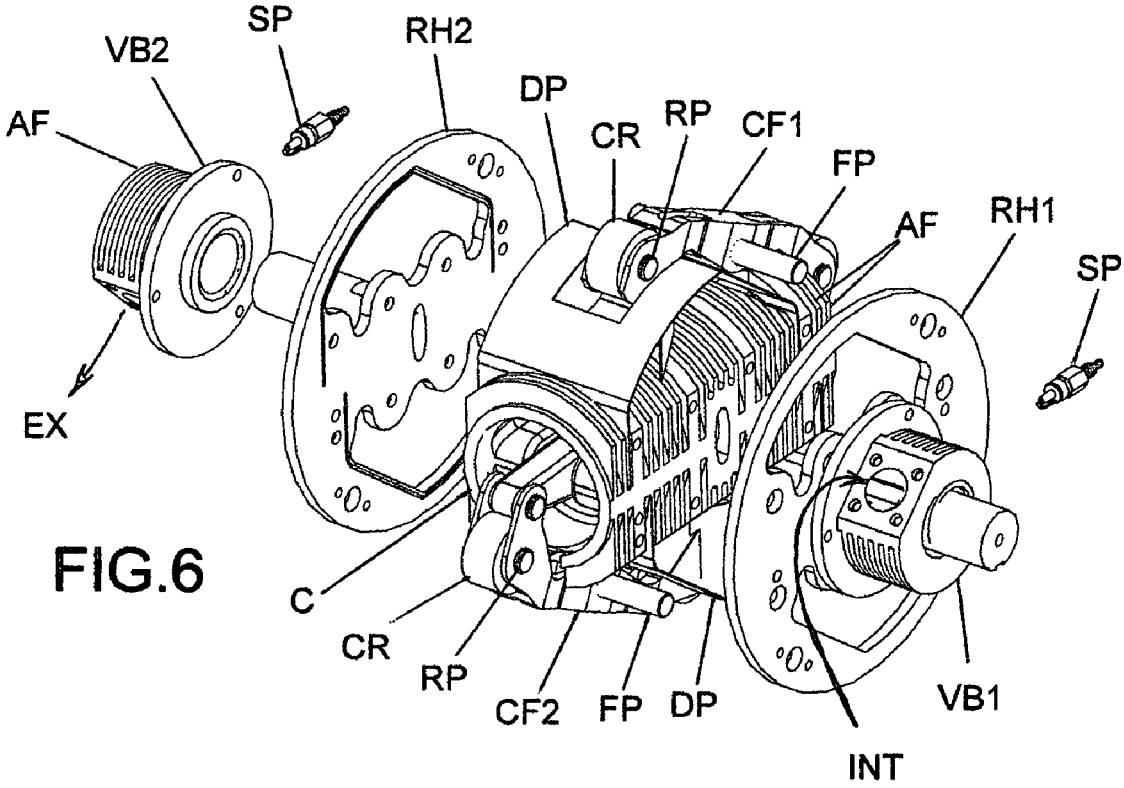
FIG. 6 shows the same view of the single port valve/bearing shown in the position of FIG. 4C with the housing and all of its elements being removed for clarification.
Figure 7:
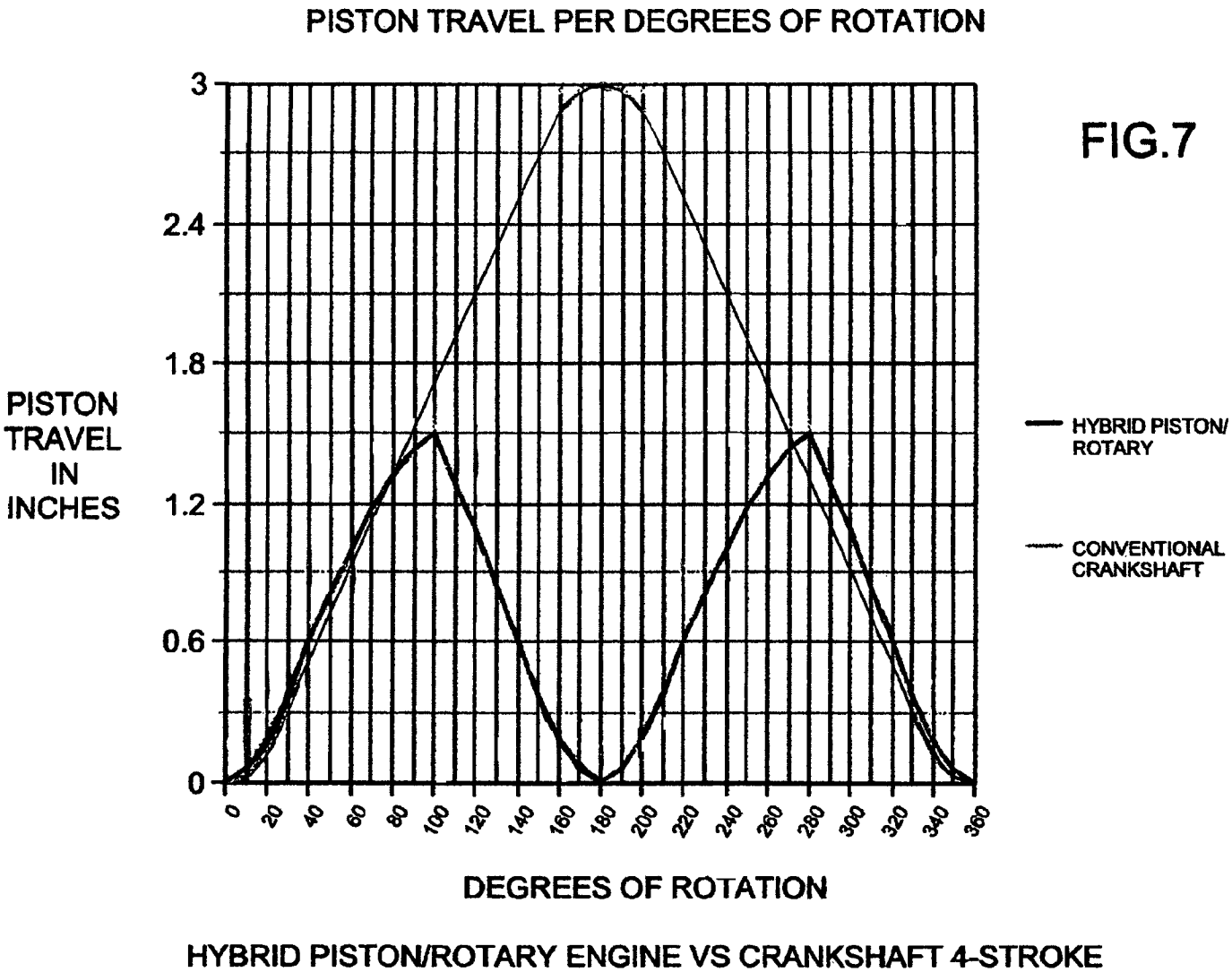
FIG. 7 is a chart showing the comparison of piston movement per degrees of rotation with the conventional crankshaft engine being compared to the hybrid piston/rotary engine.

FIG. 5, and FIG. 6, show an alternative rendition of the valve arrangement which may be preferable where lower output is acceptable. This arrangement provides one port valve, and one spark plug SP, on each valve/bearing VB. Both valve/bearings on each side of the engine are identical. (So that the designation of intake port INT, is being used on one side of the engine in the intake position, and that the identical part designated, exhaust port EX, is being utilized on the opposite side the engine in the exhaust position) Its working relation is identical to FIG. 3A, except that overall flow is from the intake side of the engine moving through toward the exhaust side of the engine and are not flowing in unison as the preferred embodiment.

Engine cooling and oiling—Referring to FIG. 6, a cylinder C, is centrally positioned on the rotor R. Upon rotation this allows continuous movement of air to flow around and about its attached air fins AF. Also positioned between rotor halves RH1 and RH2, are divider partitions # DP, which fit within grooved slots in the rotor halves and cylinder. These partitions separate the inner section of the rotor, which is dedicated for air circulation to divide the outer periphery of the rotor, where oil is contained for lubrication of the internal engine parts. Air is allowed to pass through appropriate air openings AO, on both housing sides HS. Air foils are attached to the inner surface of the divider partitions move air directionally into and out of the engine housing. Flow can be restricted as necessary to thermostatically control temperature. This arrangement offers a self contained simplified means of air-cooling the cylinder. An alternative liquid cooling means or a hybrid combination including oil is obviously considered.

Oil lubrication for the working parts of the rotor can be by conventional means by which spray nozzles in the housing would provide a stream of lubrication as the rotor rotates within. Another is to provide pressure lubrication to parts of the bearing journals to be distributed through port holes in the rotor allowing the cylinder and cam followers to receive lubrication according to conventional means. (Not shown, but is common to prior art methods)

It is best shown in FIG. 4 (A thru H), where the geometry which changes the duration (or length) of each respective stroke is altered. The intake stroke has an extended length of approx. 100 degrees with which to allow a fuel mixture to enter the cylinder. The shorter compression stroke (80 degrees in duration) circumvents heat transfer through the cylinder walls and pistons. The compression stroke is more rapid proportionally than the intake stroke and at TDC the rotor port aperture is in alignment with the spark plug, which ignites the contained gasses initiating combustion within the cylinder. This forces the pistons apart causing the connected cam followers to apply motive force against the housing which transmits power to the rotor shaft. The power stroke is greater than the compression stroke providing increased mechanical efficiency. This allows a longer duration of approx. 100 degrees to convert combusting gasses into useful energy. In FIG. 4G, the pistons are shown almost at bottom stroke (BDC) and as they are caused to make their ascent, the exhaust port is opened to allow exhaust gas to vacate the cylinder and then closed at the end of it's 80 degree stroke. All four strokes occur within 360 degrees of rotation and produces one power stroke every revolution. Conventional 4 stroke Otto cycle engines require 720 degrees (2 revolutions).

The invention claimed is:

1. A rotary machine comprising:

a) a stationary elliptical cam housing;

b) an intake port for delivering fluids;

c) an exhaust port for discharging said fluids;

d) a rotor;

wherein said rotor comprises at least one cylinder which is bisected by a connected rotor shaft perpendicular to at least one side axis of the cylinder to allow rotation;

wherein said at least one cylinder comprises two opposed pistons sharing a common chamber; and wherein said stationary elliptical cam housing includes centrally positioned bearings on each side to support a rotational movement of said rotor and a circumscribed interior of the stationary elliptical cam housing acting as a cam to provide a rigid support for thrust from the rotor;

e) at least one rotary valve provided on said bearing to control said intake port and said exhaust port through an aperture in the rotor shaft; and f) piston rods connecting the pistons to respective cam followers which pivot on shafts positioned opposite each other on the rotor;

wherein said cam followers transfer piston motion to said stationary elliptical cam housing; and wherein said cam followers pivot around rotor pins and cause said pistons to reciprocate as the rotor is caused to rotate in two complete pumping cycles with a single rotation of the connected rotor shaft, which provided four pumping strokes.

2. The rotary machine according to claim 1, wherein said at least one valve is a rotary valve.

3. The rotary machine according to claim 1, further comprising cooling means and lubrication means for cooling and lubricating said rotary machine.

4. A rotary power system comprising:

a) a stationary elliptical cam housing;

b) an intake port at least for injecting fuel and injecting air, and for delivering air-fuel mixture;

c) an exhaust port for discharging exhaust gas;

d) a rotor;

wherein said rotor comprises at least one cylinder which is bisected by a connected rotor shaft perpendicular to at least one side axis of the cylinder to allow rotation;

wherein said at least one cylinder contains two opposed pistons sharing a common combustion chamber; and wherein said stationary elliptical cam housing includes centrally positioned bearings on at least one side to support a rotational movement of said rotor and a circumscribed interior of the stationary elliptical cam housing acting as a cam to provide a rigid support for thrust from the rotor;

e) ignition means positioned in said common combustion chamber; and f) piston rods connecting the pistons to respective cam followers which pivot on shafts positioned opposite each other on the rotor;

wherein said cam followers transfer piston motion to said stationary elliptical cam housing, which is transmitted to the rotor; and wherein said cam followers pivot around rotor pins and cause said pistons to reciprocate as the rotor is caused to rotate in two complete pumping cycles with a single rotation of the connected rotor shaft, which provides four pumping strokes.

5. The rotary power system according to claim 1, wherein said ignition means comprising a spark apparatus for igniting said air-fuel mixture.

6. The rotary power system according to claim 1, wherein said ignition means comprises compression ignition.

7. The rotary power system according to claim 1, wherein said bearings provide at least one valve to control said intake port and said exhaust port through an aperture in the rotor shaft.

8. The rotary power system according to claim 7, wherein said at least one valve being a rotary valve including valve timing for advancing and retarding valve operation with respect to the operation cycles of said rotary power system.

9. The rotary power system according to claim 1, further comprising cooling means and a lubrication means for cooling and lubricating said rotary power system.

* * * * *